United States Patent [19]

Jaeger

[11] Patent Number: 5,024,004

[45] Date of Patent: Jun. 18, 1991

[54] RADIO FREQUENCY AIR FLOAT BAR

[75] Inventor: Hugh D. Jaeger, Deephaven, Minn.

[73] Assignee: W.R. Grace & Co.-Conn., New York, N.Y.

[21] Appl. No.: 490,063

[22] Filed: Mar. 7, 1990

[51] Int. Cl.[5] ..... B01K 5/00

[52] U.S. Cl. ..... 34/1; 219/10.61 R

[58] Field of Search ..... 34/1, 68, 14, 156, 160; 219/10.61 R, 10.81

[56] References Cited

U.S. PATENT DOCUMENTS 4,257,167 3/1981 Grassman .

4,638,571 1/1987 Cook ..... 34/1

*Primary Examiner*—Henry A. Bennet

*Attorney, Agent, or Firm*—Hugh D. Jaeger

[57] ABSTRACT

A radio frequency air float bar for use in floating and drying a continuous planar web of a material in a dryer. Radio frequency energy in an air bar accelerates drying, or evaporation of solvents, or curing of planar web material passing in proximity to the radio frequency air float bar either by radio frequency energy, or in combination with Coanda air flow. The radio frequency energy is capacitively coupled across the entire width of the web to ensure maximum energy transfer and even distribution.

8 Claims, 6 Drawing Sheets

RADIO FREQUENCY AIR FLOAT BAR

CROSS REFERENCE TO CO-PENDING APPLICATIONS

This application is related to U.S. patent application Ser. No. 07/203,138, filed June 7, 1988, entitled "Ultraviolet Air Float Bar"; U.S. patent application Ser. No. 07/203,076, filed June 7, 1988, entitled "Infrared Air Float Bar"; and U.S. patent application Ser. No. 07/489,902, filed Mar. 7, 1990, entitled "Microwave Air Bar", commonly assigned with this patent application.

BACKGROUND OF THE INVENTION

1 Field of the Invention

The present invention relates to a radio frequency air float bar for use in positioning, drying or curing of a continuous planar flexible material such as a web, printed web, news print, film material, or plastic sheet. The present invention more particularly, pertains to a radio frequency air float bar whose pressure pad area includes a radio frequency radiator to enhance accelerated heating of a web material to cause solvent evaporation, drying or curing. Radio frequency energy in combination with columns of heated air impinging upon the web surface provides for concentrated heating of the web material thereby providing subsequent rapid evaporation, drying or curing from the surface of the material.

2. Description of the Prior Art

Demand for increased production volume and production speed of web material in dryers has caused the printing industry to increase web speed on their printing lines. Typically this speed-up requirement resulting in the dryer being inadequate in drying the web, because the web did not remain in the dryer adjacent to a series of air bars for a sufficient length of time to dry the web because of the increased web speed. The solution for adequate drying was to either replace the entire dryer with a longer dryer, or to add additional drying zones in series with a first dryer zone. This, of course, is expensive and often times not feasible due to a shortage of physical floor space.

The present invention overcomes the disadvantages of the prior art dryers by providing a radio frequency air float bar to replace existing air float bars in web dryers. In addition to air flow of dry air from the Coanda air flow slots at the upper and outer extremities of the air float bar, a radio frequency radiator is located between the Coanda air flow slots, and transmits radio frequency electromagnetic radiation waves to the traversing web. The traversing web drying is accomplished by impingement of a combination of both heated Coanda air flow and radio frequency electromagnetic energy radiation. The combined concentration of heat from the Coanda air flow and the radio frequency electromagnetic energy radiation from the radio frequency radiator is of a sufficient magnitude which allows the web to dry at a higher speed than normal prior art speed.

U.S. Pat. No. 4,638,571, issued to Cook, teaches the use of radio frequency energy in combination with an air dryer bar. However, Cook produces an electromagnetic field between electrodes located in a plane which is parallel to the traveling web of material. The result is uneven distribution of energy across the width of the traveling web. This technique is also inefficient in the transfer of maximum energy.

SUMMARY OF THE INVENTION

The general purpose of the present invention is to provide an air float bar for use in the drying of webs in a dryer, and more particularly, provides an air float bar which includes a radio frequency radiator integrated into the air float bar for the generation and transmission of radio frequency electromagnetic energy radiation by itself or in combination with Coanda air flow upon a web traversing through the dryer. The radio frequency radiator encompasses the entire width of the air float bar and is located between the Coanda air flow slots and at the point of highest heat transfer, namely between the Coanda air flow slots. Radio frequency electromagnetic energy passes in a straight forward, direct manner to impinge upon a traversing web.

The radio frequency energy is capacitively coupled between the radio frequency radiator and the traveling web of material. The return path is through the web to ground, thus dissipating the energy in the electrical resistance of the traveling web of material.

According to one embodiment of the present invention, there is provided an air bar with an integral radio frequency radiator for the drying of a traversing web in a drying system. An air bar header member provides the framework for support and includes V or like channels on each side for the inclusion of an internal diffusion plate. Lips on the upper portion of the air bar header form one edge of Coanda slots, and a fixed position channel member with Coanda curves forms the other portion of the Coanda slots. Oval air supply inlets on the bottom of the air bar header provide air flow for the Coanda slots.

One significant aspect and feature of the present invention is an air float bar containing an integral radio frequency radiator between Coanda slots where the combination of Coanda air flow and radio frequency electromagnetic energy drys the traversing web. The traversing web is dried with either Coanda air flow, radio frequency electromagnetic energy radiation, or a combination of Coanda air flow and radio frequency electromagnetic energy radiation.

Another significant aspect and feature of the present invention is an air float bar which offers an increased heat transfer rate per size of the air bar unit which is a practical alternative solution to increasing production requirements.

Still another significant aspect and feature of the present invention is direct radiation of radio frequency electromagnetic energy to impinge uniformly upon the entire width of a traversing web in a dryer.

A further significant aspect and feature of the present invention is an air float bar that can be used to dry products that require high controlled heat and non-contact support. The air float bar can be used in curing of preimpregnated products such as polymer coatings that require airing, and are affected by high air impingement rates. The air float bar can also be used for drying of low solids, and water based coatings that are sensitive to high air impingement during the first stages of drying process. The air float bar can also be used for drying of water based coatings on steel strip webs which require high controlled heat loads. The air float bar is useful for drying webs that cannot endure high temperatures, and that experience frequent web stops. Because of the ability to switch the radio frequency energy on or off almost instantly, the air bars can be run with cold convection air for support, and the radio frequency radiator can be used as the only heat source.

Having thus described embodiments of the present invention, it is a principal object hereof to provide a radio frequency air float bar for the drying of a traversing web in a dryer.

One object of the present invention is an air float bar which features the use of Coanda air flow with radio frequency electromagnetic energy.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
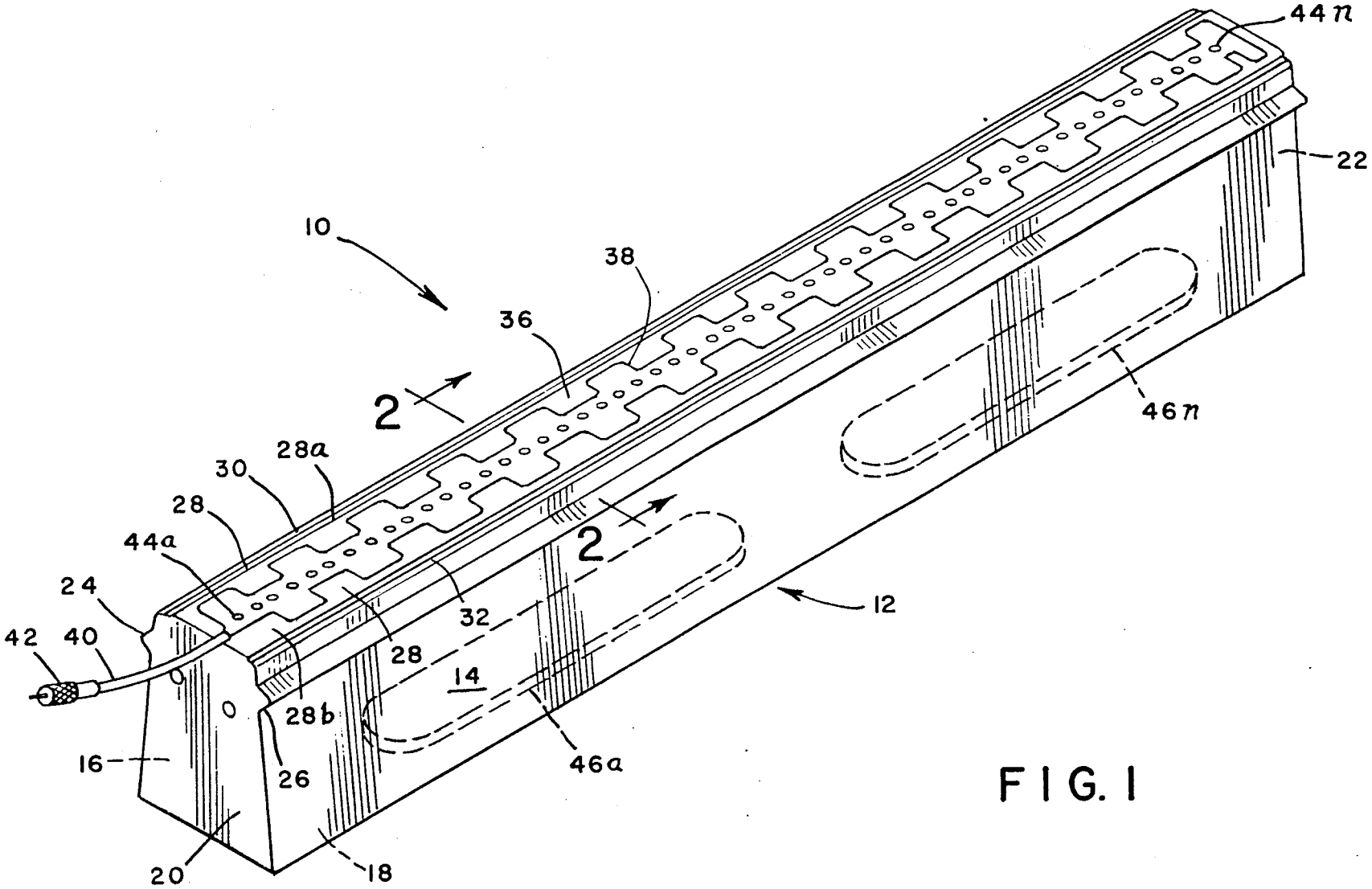
FIG. 1 illustrates a perspective view of the antenna air float bar, the present invention.
Figure 2:
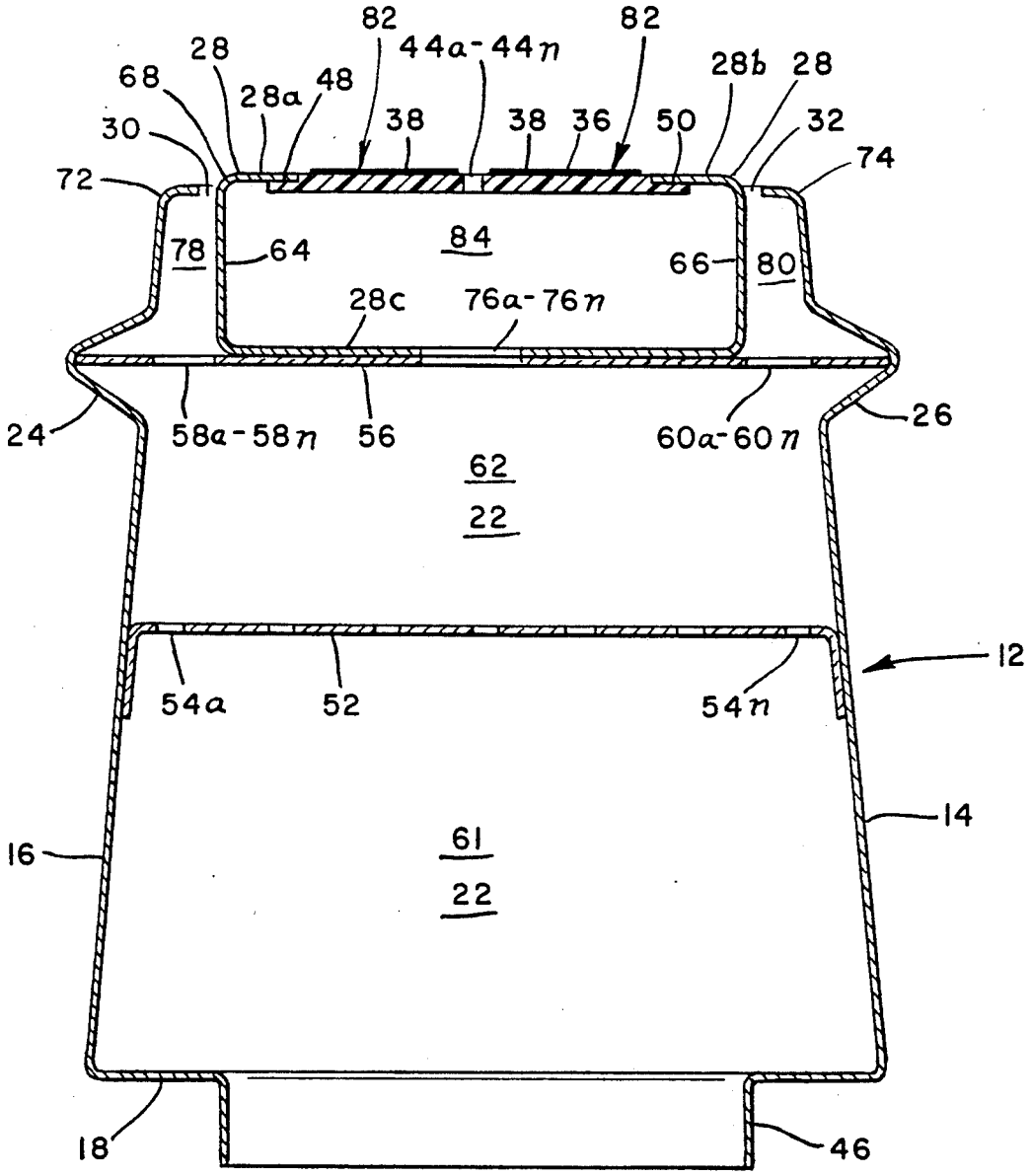
FIG. 2 illustrates a cross-sectional view of the antenna air float bar taken along line 2—2 of FIG. 1.

FIG. 1 illustrates a perspective view of a radio frequency air float bar 10, the present invention, for use in drying a web in a web dryer. Externally visible members of the air float bar 10 include a channel like air bar header 12 with opposing sides 14 and 16, a bottom 18, and opposing and parallel ends 20 and 22 affixed between sides 14 and 16. V channels 24 and 26 are formed and aligned horizontally in sides 14 and 16 to accommodate an air bar mounting flange as later described in detail. V channels 24 and 26 are also illustrated in FIG. 2. An air bar channel 28 aligns longitudinally in a precise manner between the upper regions of sides 14 and 16 to provide for forming longitudinally aligned and uniformly sized Coanda slots 30 and 32 as later described in detail. A rectangular shaped circuit board 36 is located between the opposing air bar channel edges and extends the length of the air bar channel 28. A radiator 38, integral with the circuit board 36, extends along the length of the circuit board 36 and terminates at a coaxial cable 40 and connector 42. A plurality of holes 44*a*–44*n* extend along the center line of the circuit board to allow upward forced air flow between the Coanda slots 30 and 32. A plurality of oval shaped air inlets 46*a*–46*n* position on the bottom surface 18 of the air bar header 12 to supply drying air through the air bar header 12 and to the Coanda slots 30 and 32.

FIG. 2 illustrates a cross-sectional view of the air float bar 10 taken along line 2—2 of FIG. 1 where all numerals correspond to those elements previously described. The circuit board 36 and the metallic radiator 38 are secured by bonding, screwing, or other suitable means to the air bar channel 28 between the horizontal air bar channel ends 28*a* and 28*b*. The circuit board is of an insulating material and includes longitudinal cutout areas 48 and 50 which accommodate the air bar channel ends 28*a* and 28*b* to form a smooth transition between the air bar channel 28 and the circuit board 36 containing the integral radiator 38. A diffuser plate 52 with a plurality of holes 54*a*–54*n* secure between sides 14 and 16 to provide for even flow of drying air from the plurality of oval shaped air inlets 46*a*–46*n*. A support plate 56 positions between V channels 24 and 26, and includes a plurality of holes 58*a*–58*n* and 60*a*–60*n* extending longitudinally along the support plate 56 and parallel to the V-channels 24 and 26, respectively. The plurality of holes 58*a*–58*n* and 60*a*–60*n* align longitudinally in two opposing rows along the outer regions of the support plate 56. The bottom 18, sides 14 and 16, ends 20 and 22, and the diffuser plate 52 define a first chamber 61. The diffuser plate 52, sides 14 and 16, ends 20 and 22, and the support plate 56 define a second chamber 62. The fixed air bar channel 28 secures by welding or other suitable attachment to the support plate 56, and includes sides 64 and 66, Coanda curves 68 and 70, and horizontal planar surfaces 28*a* and 28*b* at right angles to sides 64 and 66. Angled and curved lips 72 and 74, extensions of sides 16 and 14, extend inwardly at right angles to form Coanda slots 30 and 32 between the ends of angled and curved lips 72 and 74 and Coanda curves 68 and 70, respectively, each slot being of a finite size. A plurality of holes 76*a*–76*n* extend through the center line and longitudinally along the bottom portion 28*c* of the air bar channel 28 and the support plate 56. Chamber 78 is formed by the fixed air bar channel side 64, the outer portion of support plate 56, the upper portion of side 16 and the angled lip 72. In a similar fashion, chamber 80 is formed by the fixed air bar channel side 66, the outer portion of support plate 56, the upper portion of side 14 and the angled lip 74. The area between the Coanda slots 30 and 32, known as the pressure pad 82, includes the circuit board 36 and the radiator 38, air bar channel ends 28*a* and 28*b* and Coanda curves 68 and 70. Another chamber 84 is formed by the interior surfaces of air bar channel sides 64 and 66, air bar channel bottom 28*c*, radiator members 38*a* and 38*b* of the air bar channel 28 and by the circuit board 36.

While a single radiator 38 is illustrated, a plurality of radiating elements mounted in a parallel fashion can be used for applications requiring more surface area for radiation of radio frequency magnetic energy. Larger air float bar assemblies can include multiple parallel radiator elements to transmit radio frequency electromagnetic energy radiation to a traversing web.

Figure 3:
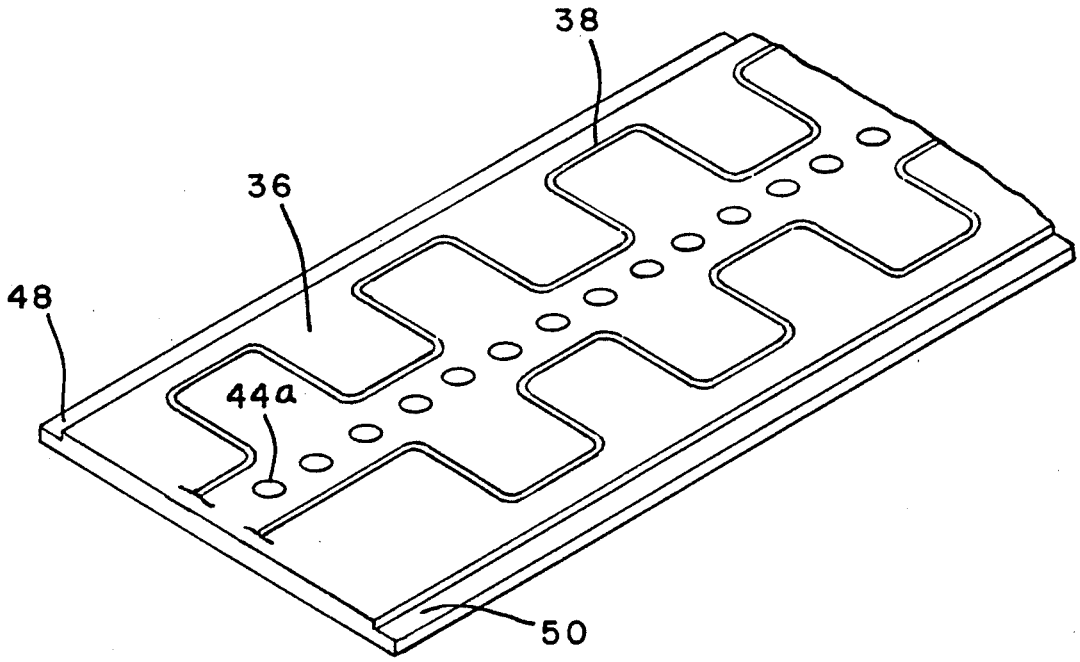
FIG. 3 illustrates a perspective view of the antenna air float bar.

FIG. 3 illustrates a perspective view of the circuit board 36 and integral radiator 38. Illustrated in particular are the cutout areas 48 and 50 extending longitudinally along and about the edges of the circuit board 36. All numerals correspond to those elements previously described.

MODE OF OPERATION

Figure 4:
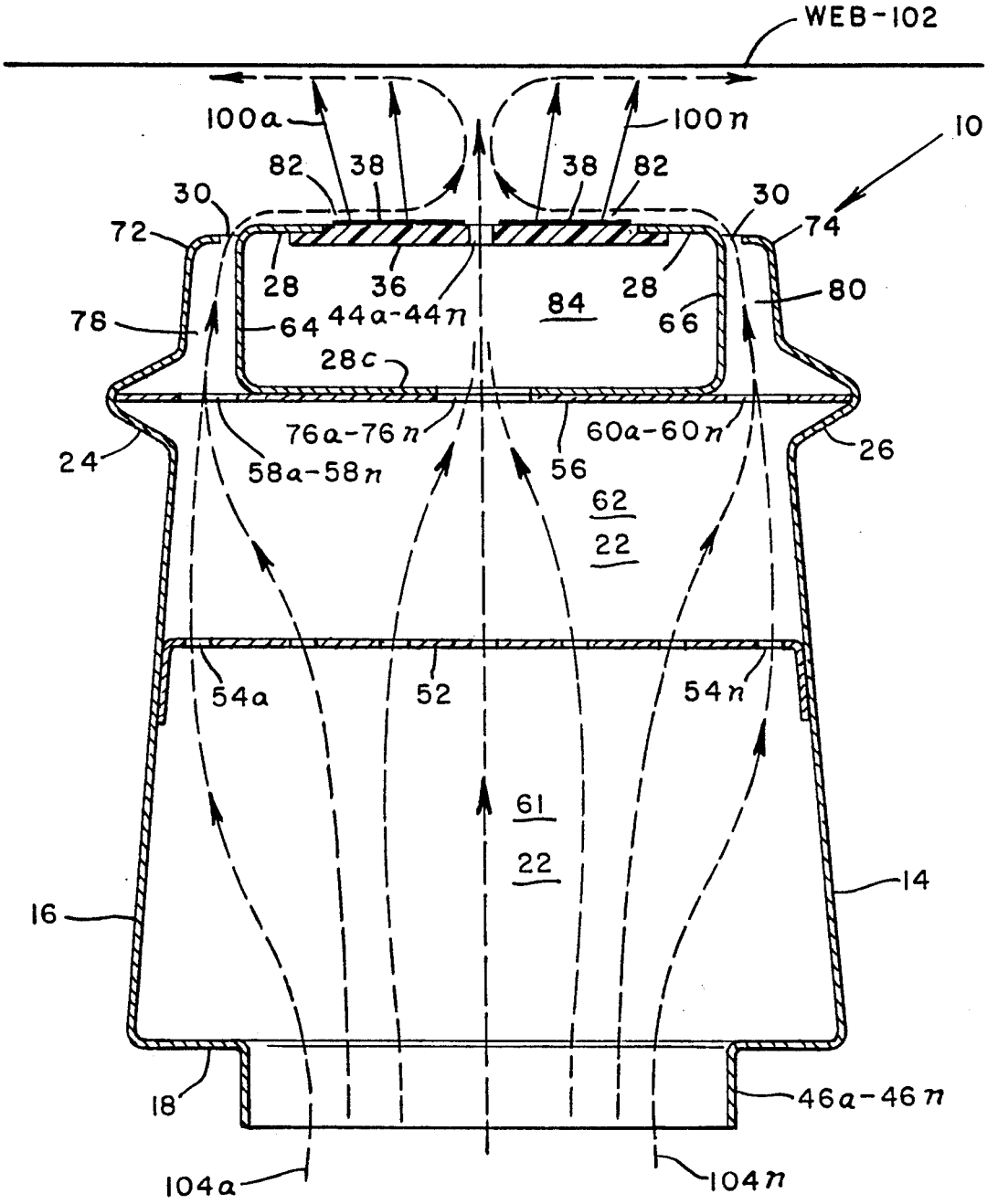
FIG. 4 illustrates a cross-sectional end view of the mode of operation of the antenna air float bar.

FIG. 4 shows the mode of operation of the antenna air float bar 10 where all numerals correspond to those elements previously described. A plurality of radio frequency electromagnetic energy waves 100*a*–100*n* increase drying capacity because the radiator 38 is located at the point of highest heat transfer, namely between the Coanda slots 30 and 32, and radiate from the radiator 38 directly to and impinge upon a web 102. The radio frequency drying energy waves 100*a*–100*n* are transmitted for heating a traversing web 102 being processed in a dryer. The wave length of the radio frequency electromagnetic waves 100*a*–100*n* emitted from the radiator 38 can be short wave with a wave length of about two meters, medium wave length with a wave length of about eleven meters or long wave length of at least twenty meters. The radiator 38 is positioned at a point of maximum energy transfer.

Pressurized air to float the web 102 enters the air float bar 10 through the plurality of oval shaped air inlets 46*a*–46*n* to float the web 102 above the pressure pad 82. From the oval shaped air inlets 46*a*–46*n*, the pressurized air particles 104*a*–104*n* flow proceeds as indicated by dashed arrow lines through the first chamber 61, through holes 54*a*–54*n* of the diffuser plate 52, into the second chamber 62, through the pluralities of holes 58*a*–58*n*, 60*a*–60*n* and holes 76*a*–76*n* of the support plate 56, through chambers 78 and 80, through the Coanda slots 30 and 32 along Coanda curves 68 and 70, and then inwardly along the upper surface of the circuit board 36 and upwardly, thus providing float lift for the web 102 and also carrying away solvent vapors in the web. Air passing through holes 76*a*–76*n* enter chamber 84 and exit through the plurality of holes 44*a*–44*n* to aid and assist in air drying of the web 102. Radio frequency energy waves 100*a*–100*n* impinge directly on the web 102 and heat the web 102 as it passes over the pressure pad 82, thus drying and evaporating solvents from the web 102. This, in combination with impinging flow of air particles 104*a*–104*n*, maximizes the heat transfer in the area of the pressure pad 82.

Output of the radiator 38 can be variably controlled, so that the amount of radio frequency energy output transmitted from the radiator 38 includes a range from full power to no power, and any variable range therebetween.

Figure 5:
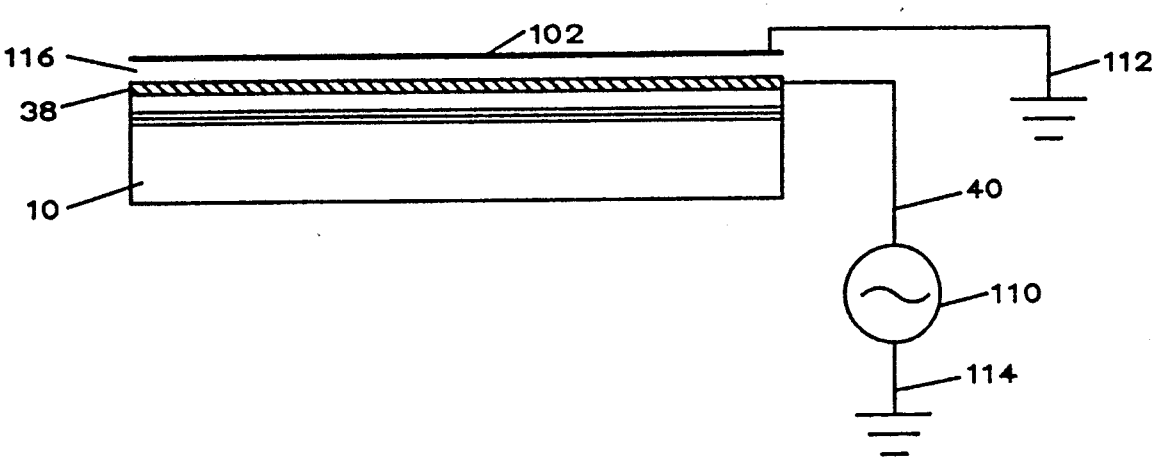
FIG. 5 is a simplified diagram of the electrical operation of radio frequency curing; and, FIG. 6 is an equivalent electrical schematic of the radio frequency circuit.

FIG. 5 is a conceptual view of the radio frequency operation of air float bar 10. Signal generator 110, which is grounded by line 114, generates the radio frequency signal that is coupled to radiator 38 via coaxial cable 40. The radio frequency energy is capacitively coupled from radiator 38 to traveling web 102 through gap 116. The return path is via traveling web 102 and ground connection 112. Because virtually all of the radio frequency energy is dissipated in the distributed resistance of traveling web 102, the energy is efficiently used in the curing process.

Figure 6:
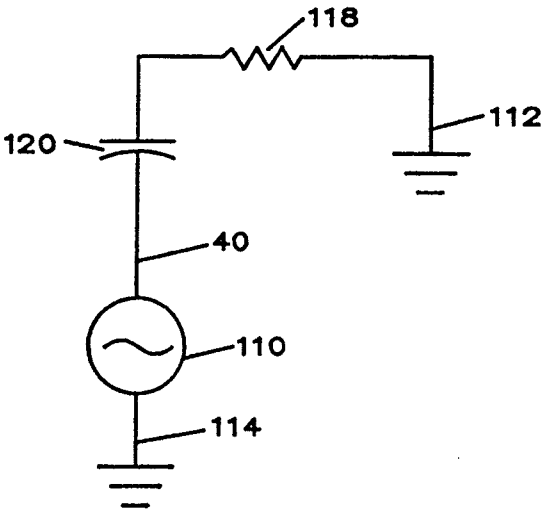

FIG. 6 is an equivalent electrical schematic. Gap 116 (see also FIG. 5) provides gap capacitance 120. The distributed resistance of traveling web 102 is shown as resistor 118. The efficiency is enhanced by dissipation of most of the energy in resistor 118.

Various modifications can be made to the present invention without departing from the apparent scope thereof.

We claim:

1. An air bar for supporting and curing a traveling web of material having a width comprising:

a. means for providing a pressurized gas;
b. means coupled to said providing means to direct said pressurized gas into contact with said traveling web of material;
c. source of radio frequency energy;
d. means responsibly coupled to said source of radio frequency energy for uniformly coupling said radio frequency energy across said width of said traveling web of material; and,
e. means for capacitively coupling said radio frequency energy to said traveling web of material.

2. An air bar according to claim 1 wherein said capacitively coupling means further comprises a conductive plate attached to said directing means.

3. An air bag according to claim 2 wherein conductive plate extends the entire width of said directing means.

4. An air bar according to claim 3 wherein said source of radio frequency energy supplies radio frequency energy at about 27 megahertz.

5. A method of curing a traveling web of material comprising:

a. directing a pressurized gas at said traveling web of material;
b. developing a radio frequency signal;
c. coupling said radio frequency signal across the width of said traveling web of material; and,
d. capacitively coupling said radio frequency signal across the width of said traveling web of material.

6. A method according to claim 5 wherein said developing step further comprises developing a radio frequency signal of about 27 megahertz.

7. A radio frequency air bar for supporting and curing a traveling web of material having a width comprising:

a. means for providing a pressurized gas;
b. means coupled to said providing means to direct said pressurized gas into contact with said traveling web of material;
c. source of radio frequency energy;
d. antenna means responsibly coupled to said source of radio frequency energy for uniformly coupling said radio frequency energy to and across said width of said traveling web of material; and,
e. means for capacitively coupling said radio frequency energy to said traveling web of material.

8. A method of curing a traveling web of material comprising:

a. directing a pressurized gas at said traveling web of material;
b. developing a radio frequency signal;
c. coupling said radio frequency signal to an antenna disposed across the width of said traveling web of material; and,
d. capacitively coupling said radio frequency signal to and across the width of said traveling web of material.

* * * * *